United States Patent [19]

Mayo

[11] Patent Number: 4,745,250

[45] Date of Patent: May 17, 1988

[54] INTERLOCK SWITCH BASEPLATE ASSEMBLY

[75] Inventor: Stephen K. Mayo, Memphis, Tenn.

[73] Assignee: Litton Systems, Inc., Beverly Hills, Calif.

[21] Appl. No.: 43,216

[22] Filed: Apr. 27, 1987

[51] Int. Cl.[4] ..... H01H 9/00; H05B 6/64

[52] U.S. Cl. ..... 219/10.55 C; 200/50 A; 200/50 C; 200/61.62

[58] Field of Search ..... 200/50 A, 50 R, 50 C, 200/61.62, 61.76; 219/10.55 B, 10.55 C, 10.55 D

[56] References Cited

U.S. PATENT DOCUMENTS 4,663,505 5/1987 Drake ..... 219/10.55 C

*Primary Examiner*—Scott. J. R.

*Attorney, Agent, or Firm*—John M. Haurykiewicz; Walter R. Thiel

[57] ABSTRACT

An interlock switch assembly is disclosed having a unitary baseplate with relatively few moving parts and making use of conventional low cost miniature switches, each positively located and retained with respect to the baseplate. First and second actuators convert, respectively, linear motion of first and second operators into rotary motion to actuate the miniature switches. Switch actuation is prevented unless the properly timed motion of both operators is received by the actuators. A third actuator receives the motion of the first operator and actuates a third switch in response thereto. In one embodiment, the third actuator is prevented from actuating the third switch until after actuation of the first and second switches. In one embodiment, a primary interlock switch is the first switch deactuated and is preferably capable of interrupting power to the microwave energy source when the door is opened before the cooking cycle is completed. In this embodiment, the next switch to be deactuated is a logic monitor switch, followed by release of a secondary interlock switch acting as a backup to the primary interlock switch. Finally, an interlock monitor switch is deactuated preferably placing a short circuit across the load side of a power circuit of the switch assembly in order to blow a fuse in the event of a "failed-closed" condition of both the primary and secondary interlock switches in the deactuated state.

10 Claims, 8 Drawing Sheets

22a'
C
28a'
26a,b
94
24a
C'
34
16'
100
24b'
118
102
38
B
28b'
108'
33a'
33b'
C
B
A'
C
18'
30
48
46
C
36
B
21'
C
14
32
C
12'
10'
22b'

INTERLOCK SWITCH BASEPLATE ASSEMBLY

BACKGROUND OF THE INVENTION

In the past, designs of interlock switch assemblies for microwave ovens have progressed from relatively complex assemblies made up of a number of switches individually mounted in sheet metal bracket assemblies requiring individual switch adjustments to custom interlock switch modules containing a plurality of specially designed switches positively positioned within a unitary housing. Such custom interlock switch modules reduced the number of adjustments but required relatively costly tooling because of the need for completely redesigned switch elements.

In switch designs overcoming the need for custom designed switch elements such as that shown in U.S. patent application Ser. No. 866,115 now U.S. Pat. No. 4,663,505 filed May 22, 1986 by George Michael Drake, it has been found desirable to provide still further improvements to further prevent actuation except in response to door closing.

SUMMARY OF THE INVENTION

The present invention provides for an improvement in a unitary switch module by providing an additional actuator which is designed to receive door operator motion to actuate an interlock switch. The actuator is designed to be tamper-proof in that it is relatively inaccessible even through the door operator apertures in the front wall of the unitary switch module and is held in the deactuated state until the other actuators move to their respective enabling positions.

DETAILED DESCRIPTION OF THE PREFERRED EMBODIMENTS

Figure 1A:
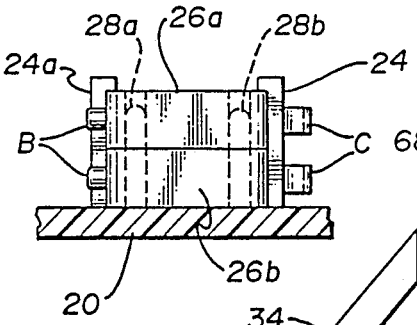
FIG. 1A shows a detail view of the mounting arrangement for a pair of stacked switches taken along line 1A—1A of FIG. 1.
Figure 1:
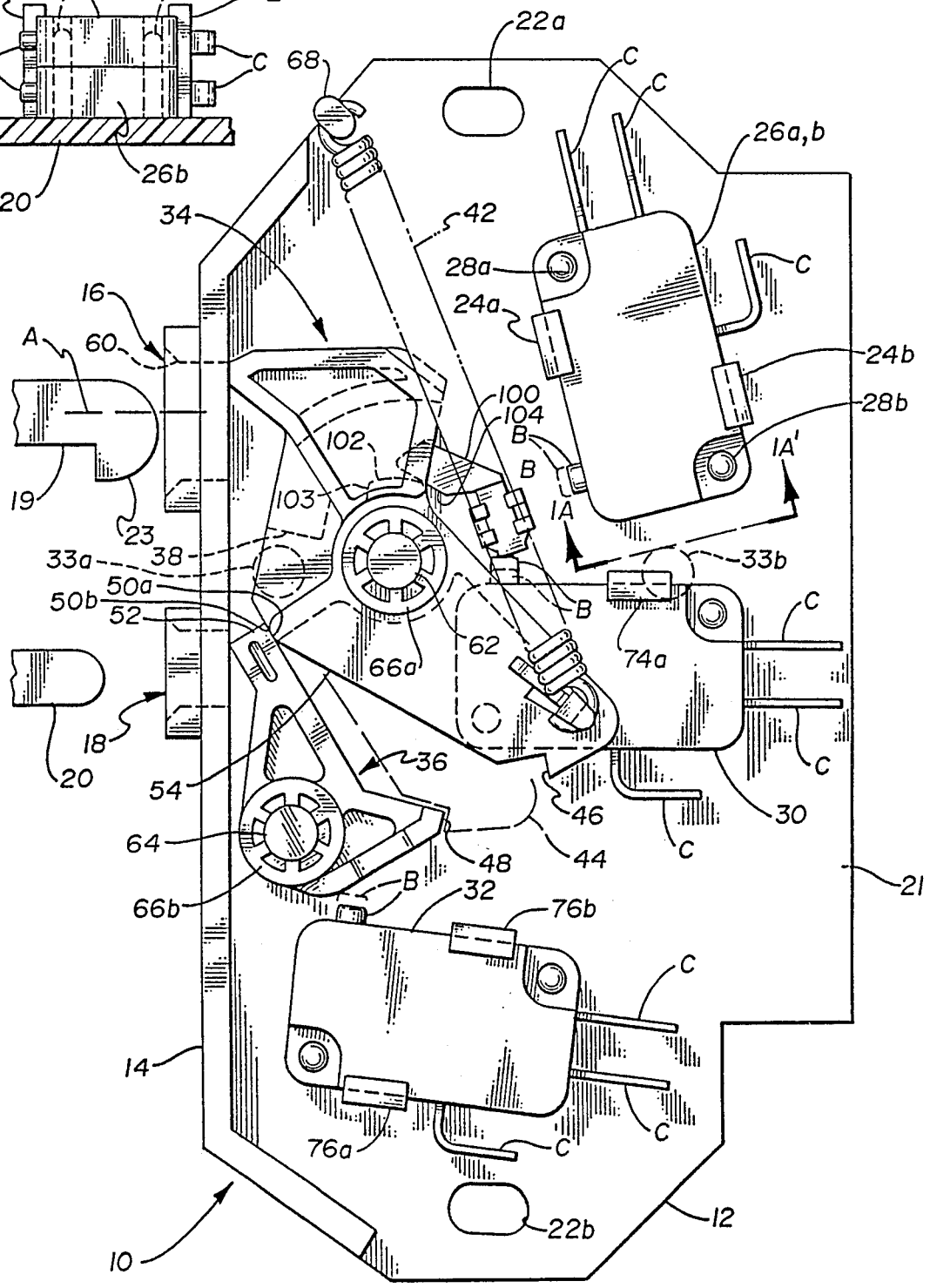
FIG. 1 shows a side view of one embodiment of the interlock switch assembly in the deactuated state.

Referring to FIG. 1, an interlock switch assembly 10 is shown, having a unitary baseplate or frame 12. Frame 12 has a front wall or panel 14 containing first and second apertures 16, 18, respectively adapted to receive first and second operators 19, 20 in a direction parallel to axis A. Operators 19 and 20 are preferably hook-type and bayonet-type operators respectively, and are secured to the door of a microwave oven. Operator 19 preferably has an enlarged distal portion 23 and retains the door in a closed position while the switch assembly is actuated. In FIG. 1, switch assembly 10 is shown in the deactuated state which corresponds to a door-open state of the microwave oven with the operators withdrawn from apertures 16, 18. Frame 12 also has a generally planar wall or mounting surface 21 preferably at a right angle to front wall 14. Surface or base 21 has elongated apertures **22*a,b* adapted for mounting assembly 10 to a microwave oven and for allowing adjustment only along a direction parallel to axis A. Apertures 22*a,b* are preferably, but not necessarily, used in cooperation with bosses or studs 33*a,b* which are to be received in mating slots in the mounting surface to which base 12** is secured.

Surface 21 has a pair of rectangular fingers **24*a*,24*b* to positively retain a pair of miniature switches 26*a*,26*b*. Switches 26*a*,26*b* are positively located to assembly 10 at a pair of cylindrical posts 28*a*,28*b*. Fingers 24*a,b* and posts 28*a*,28*b* are preferably integrally molded to base 21. FIG. 1A shows mounting details and the stacked arrangement of switches 26*a*,26*b*. Similar arrangements are provided for individual switches 30 and 32**.

Each of switches **26*a*,26*b*, 30, and 32 has an external actuating button B, and means for external electrical connection C. Although three electrical connections are shown for each switch, in the preferred embodiment switch 26*a* has a normally-open contact and functions as a logic monitor switch 26*b* is a normally-open and functions as a secondary interlock, switch 30** is a normally-open and functions as primary interlock switch, and switch 32 has a normally-closed contact and functions as an interlock monitor switch.

A first actuator 34 receives and converts the motion of operator 19 from a linear motion into a rotary motion and sequentially actuates switches 26*a* and 26*b*.

A second actuator 36 receives and translates the linear motion of operator 20 into a rotary motion to actuate second actuator switch 32. Actuators 34 and 36 are designed to mechanically interlock with each other to prevent any switch actuation in the event that only one of operators 19, 20 is received through apertures 16, 18.

A third actuator 100 receives a portion of the motion of operator 19 to operate switch 30. Actuators 34 and 100 have interengaging surfaces 102, 104 preventing actuation of switch 30 while actuator 34 is in either a deactuated or intermediate position. When actuator 34 is in its actuated position, inner cam 102 provides a clearance region 118 which permits movement of actuator 100. Clearance region 118 is obscured from view through aperture 16 when actuator 34 is in the actuated state.

Figure 2:
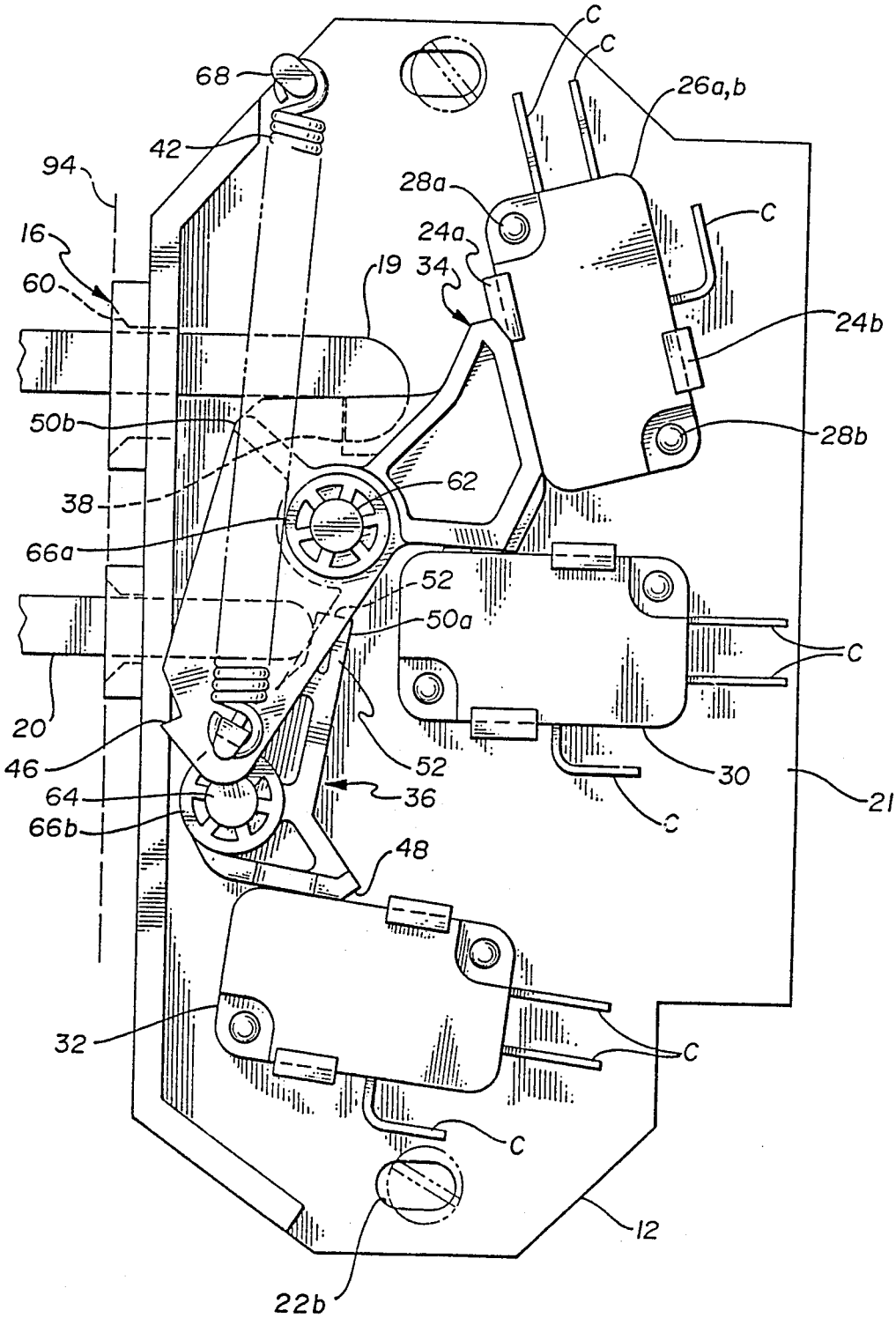
FIG. 2 shows a side view of the interlock switch assembly of FIG. 1 in the actuated state.

As may be best seen in FIG. 2, once operators 19 and 20 are fully received in assembly 10, all switches are actuated, and because operator 19 is a hook-type operator which engages a surface 38 on actuator 34, hook-type operator 19 is restrained from withdrawal through aperture 16 while the switches are in the actuated state. It is to be understood that FIG. 1 corresponds to an open door condition while FIG. 2 corresponds to a closed-door condition of a microwave oven. As may be seen in FIG. 6, door 96 has operators 19 and 20 preferably rigidly affixed thereto and switch assembly 10 is located behind the front panel 94 (shown in phantom in FIG. 2) of the microwave oven. Phantom panel 94 corresponds a section view of front panel 94 of FIG. 6. Although the microwave oven 92, door 96, operators 19 and 20 and front panel 94 form no part of the interlock switch assembly per se, they are shown in the figures as an aid in understanding this invention.

As actuator 34 moves between the deactuated state shown in FIG. 1 and the actuated state shown in FIG. 2, a spring 42 provides an over-center action to retain actuator 34 in either the actuated or the deactuated state.

In the event that an attempt is made to operate assembly 10 by inserting a projection or operator into aperture 16 without a corresponding operator being inserted into aperture 18, actuator 34 progresses to position 44, shown in phantom in FIG. 1. At this point, surfaces 46, 48 on actuators 34, 36 respectively, engage each other, prohibiting further travel of actuator 34.

Alternatively, if an operator is inserted into aperture 18 without a corresponding operator being inserted into aperture 16, interengaging surfaces 50*a*,50*b* prevent motion of actuator 36.

Figure 3:
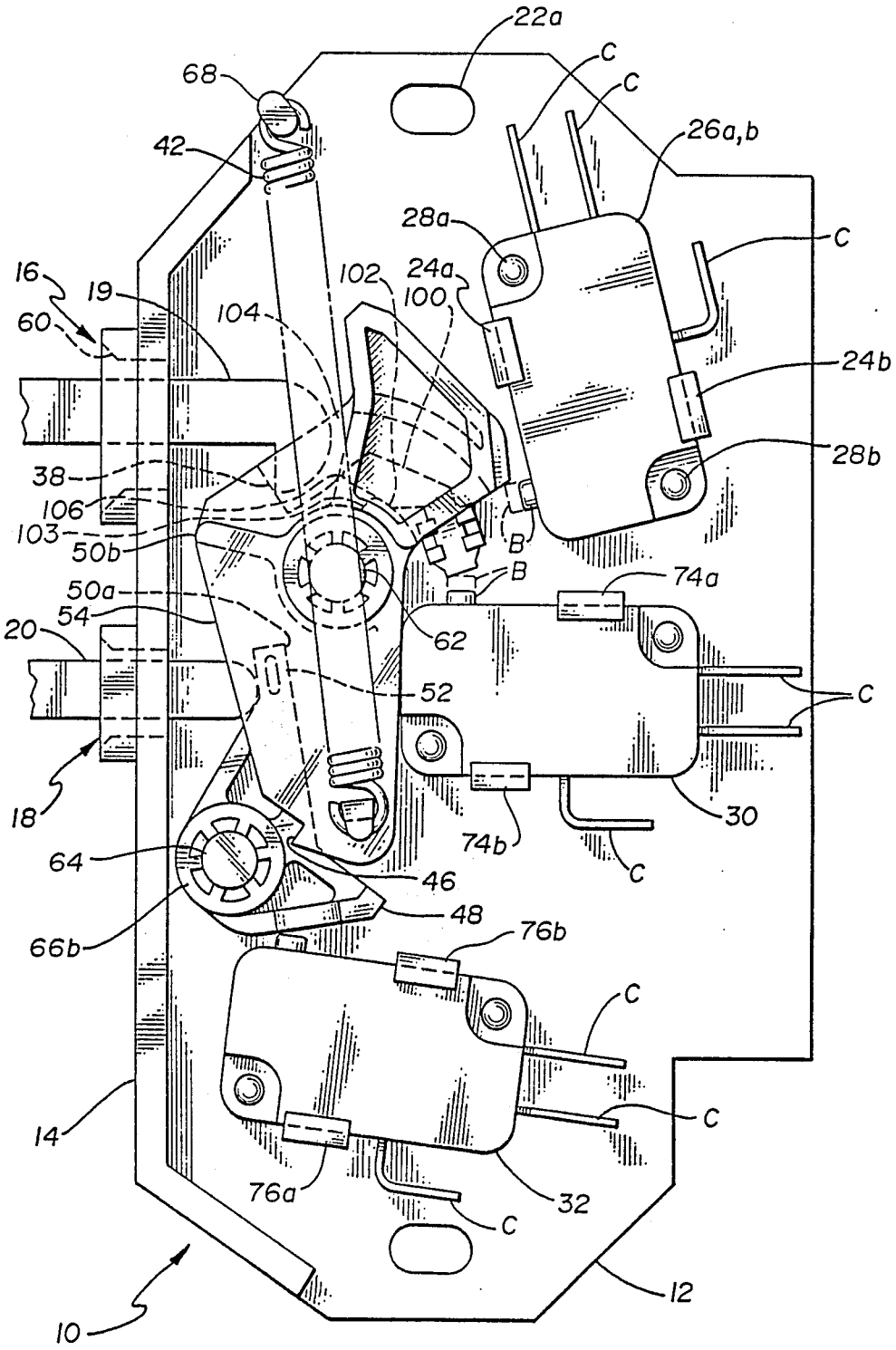
FIG. 3 shows a side view of the interlock switch assembly of FIGS. 1 and 2 in a state intermediate the actuated and deactuated states.

During normal operation, as the oven door is closed, operator 19 moves actuator 34 slightly so that surfaces 50*a*,50*b* no longer interengage and projection 52 on actuator 36 is free to enter recess or clearance region 54 in actuator 34 as may be more clearly seen in FIGS. 2 and 3.

FIG. 3 shows interlock switch assembly 10 in an intermediate position with interengaging surfaces 50*a*,50*b* and 46, 48 displaced and free to travel past each other. This action permits actuators 34, 36 to continue to progress to the actuated position as shown in FIG. 2.

With operators 19, 20 in positions as shown in FIGS. 1 and 3 (and in positions intermediate thereto) actuator 100 is prevented from actuating switch 30 by the interference between an inner cam or surface 102 on actuator 34 and surface 104 on actuator 100. As operators 19, 20 progress to the closed-door position of FIG. 2, cam surface 102 rotates away to provide clearance 118 for movement of third actuator 100. At the same time (as may be seen more clearly in FIG. 8B) operator 19 urges driving surface 106 on actuator 100 to move actuator 100 towards button B on switch 30, actuating switch 30.

Figures 4A, 4B, 4C, 4D, 4E, 4F:
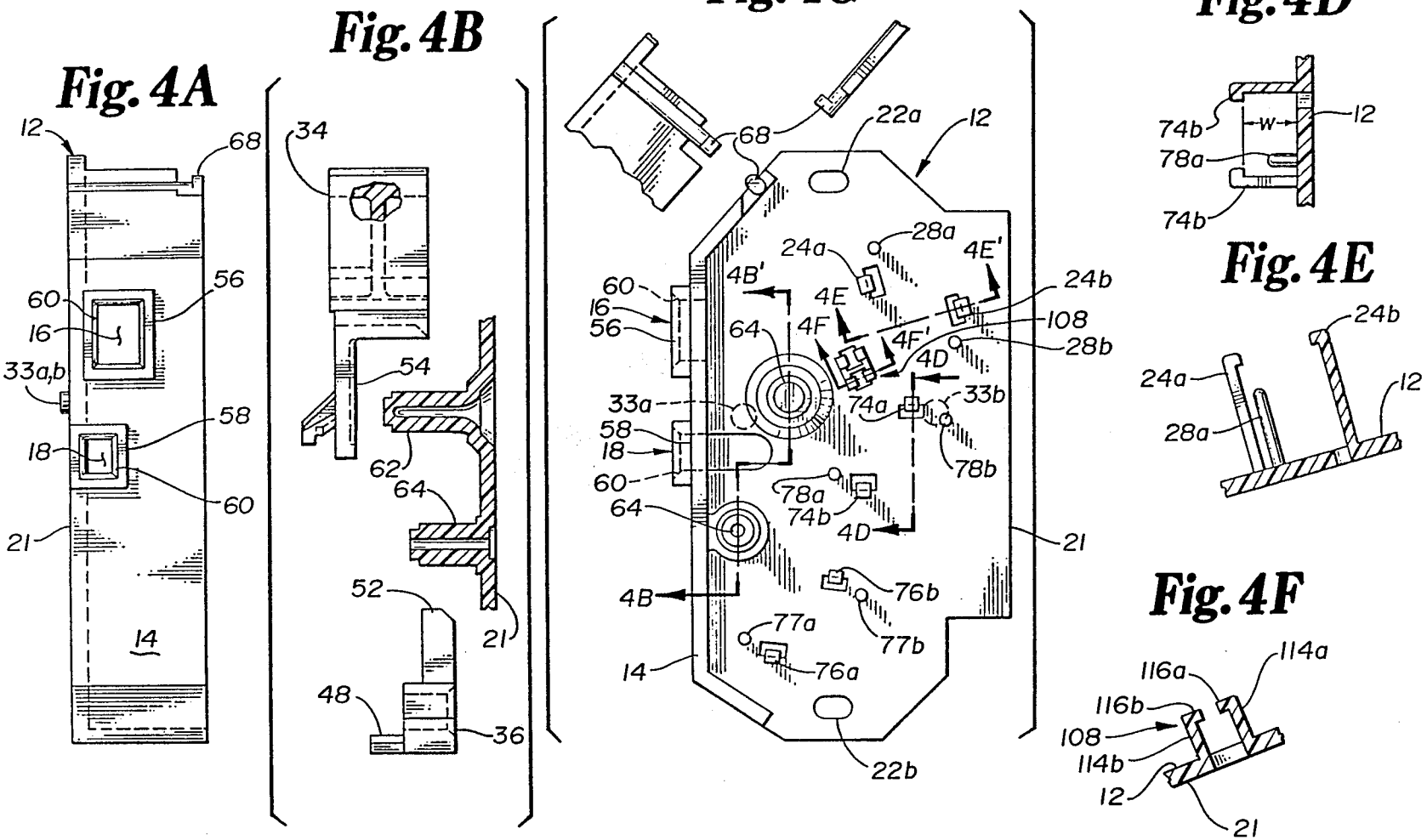
FIG. 4A shows a front view of the baseplate of FIG. 1.
FIG. 4B shows a composite section and exploded view of a portion of the baseplate taken along line 4B—4B of FIG. 4C and the mounting arrangement of the actuators of FIG. 1.
FIG. 4C shows a side view of the baseplate and detail views of a spring-retaining projection on the baseplate of FIG. 1.
FIG. 4D shows a partial section detail view taken along line 4D—4D of FIG. 4C of switch retaining fingers and locating post for a switch to be mounted on the baseplate of FIG. 1.
FIG. 4E shows a partial section detail view taken along line 4E—4E of FIG. 4C of fingers and a post for retaining and locating a plurality of switches to be mounted on the baseplate of FIG. 1.
FIG. 4F shows a partial section detail view taken along line 4F—4F of FIG. 4C of an actuator-retaining channel on the baseplate of FIG. 1.

FIGS. 4A–4F shows various details of baseplate 12. More particularly, FIG. 4A shows a front view of the front wall or panel 14 indicating the relative position of apertures 16 and 18. Preferably, apertures 16 and 18 are surrounded by frames 56, 58 respectively which have a beveled interior surface 60 to assist in receiving operators 19 and 20.

FIG. 4B shows a partial section view of frame 12 and further shows an exploded view of the partial assembly including actuators 34 and 36. More particularly, actuator 34 is received on a first shaft 62 and actuator 36 is received on a second shaft 64. Actuators 34 and 36 are retained on their respective shafts by means such as retaining rings 66*a*,66*b* (shown in FIG. 1). Alternatively, other fastening means may be used which restrain axial movement of the actuators while permitting rotational movement.

Referring now more particularly to FIG. 4C, still further details of the baseplate 12 may be seen. A projection 68 shown in top, front and side views is designed to receive and retain one end of spring 42. A track 108 is adapted to retain actuator 100 on baseplate 12 while permitting sliding movement of actuator 100 with respect to baseplate 12.

The mounting arrangement for the single height and double height stacked switches are shown respectively in FIGS. 4D and 4E. Rectangular fingers 74*a*,74*b* and cylindrical post 78*a* are similar to fingers 24*a*,24*b* and post 28*a*, except that they are shorter by the width W of one miniature switch 26. Fingers 76*a*,76*b* and posts 77*a*,77*b* are preferably the same as fingers 74 and post 78.

FIG. 4F shows the detail of mounting track 108 which is preferably formed integrally with planar surface 21 of frame 12. Track 108 has parallel opposing sides 114*a*,114*b* and overlapping edges 116*a*,116*b* to retain actuator 100 in a sliding relationship to baseplate 12.

Figures 5A, 5B, 5C, 5D, 5E, 5F, 5G, 5H, 5I, 5J, 5K:
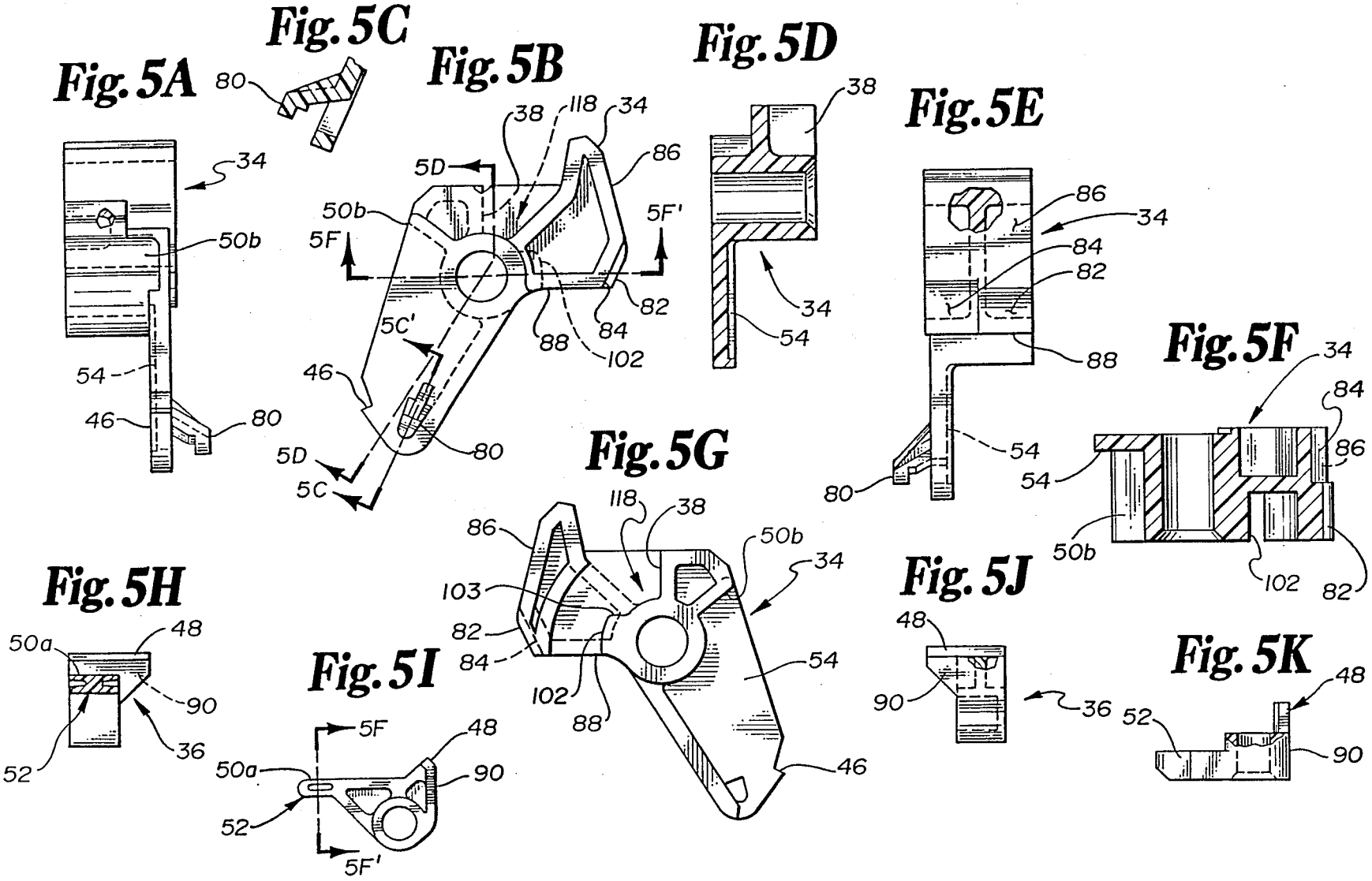
FIG. 5A shows a front view of a first actuator.
FIG. 5B shows a side view of the first actuator.
FIG. 5C shows a partial section view of a spring retaining projection on the first actuator taken along line 5C—5C of FIG. 5B.
FIG. 5D shows another partial section view through the first actuator taken along line 5D—5D of FIG. 5B.
FIG. 5E shows a rear view of the first actuator.
FIG. 5F shows a section view through the first actuator taken along line 5F—5F of FIG. 5B.
FIG. 5G shows a back view of the first actuator.
FIG. 5H shows a partial section view through a second actuator taken along line 5H—5H of FIG. 5I.
FIG. 5I shows a side view of the second actuator.
FIG. 5J shows a rear view of the second actuator.
FIG. 5K shows a top view of the second actuator.

Referring now more particularly to FIGS. 5A–5J, the various details of actuators 34 and 36 may be seen. Interengaging surface 50*b* may be seen in FIGS. 5A, B and 5F. A cross-section of a spring retaining projection 80 on actuator 34 is shown in FIG. 5C. FIG. 5D shows surface 38 which is adapted to retain the hook of operator 19.

FIGS. 5B and 5E shows first and second initial cam surfaces 82,84 and a common final cam surface 86. First initial cam surface 82 engages and actuates switch 26*b* prior to second initial cam surface engaging and actuating switch 26*a*. Subsequently, common final cam surface 86 maintains both switches 26*a*,26*b* actuated.

FIGS. 5B, 5F and 5G show views of the inner cam surface 102 of actuator 34.

FIG. 5G shows the details of the back of actuator 34, including clearance region 118 adjacent inner cam 102.

Referring now more particularly to FIGS. 5H–5I, the various views and details of actuator 36 may be seen.

FIG. 5H shows a cross-section through projection 52. FIGS. 5I, 5J and 5K show the details of interengaging surfaces 48 and 50*a* which prevent actuation of any switch unless both operators 19 and 20 are received through apertures 16, 18 to operate actuators 34 and 36 in the proper timing sequence. Finally, actuator 36 has a switch contacting surface 90 which actuates switch 32 when actuator 36 is driven to the actuated position by operator 20.

Figure 6:
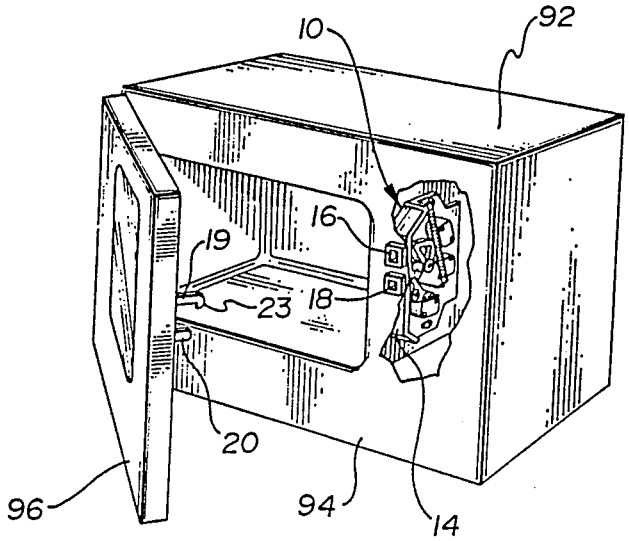
FIG. 6 shows a microwave oven partially cutaway to illustrate an interlock switch baseplate assembly of this invention installed in an oven.

Referring now more particularly to FIG. 6, interlock switch assembly 10 is shown in a microwave oven 92 having a front panel 94 and a pivoting microwave oven door 96, which carries first and second operators 19, 20. Assembly 10 is mounted in oven 92 such that first and second apertures 16, 18 located in the front wall 14 of assembly 10 are positioned to align with corresponding apertures in the front panel 94 of oven 92.

Figure 7B:
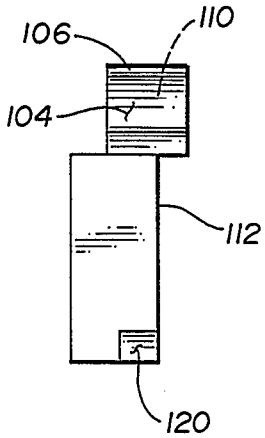
FIG. 7B shows an end view of the third actuator.
Figure 7A:
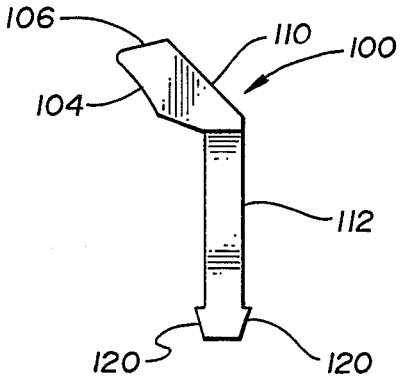
FIG. 7A shows a side view of the third actuator.
Figure 7C:
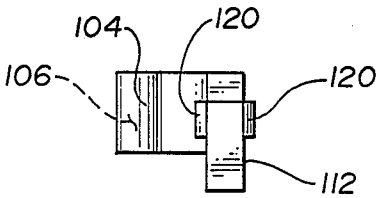
FIG. 7C shows a bottom view of the third actuator.

Referring now more particularly to FIGS. 7A, 7B and 7C, the third actuator 100 may be seen. Actuator 100 has driving surface 106 and engaging surface 104 on a head portion 110. Head portion 110 is preferably formed integrally with guide portion 112. Guide portion 112 is retained in track 108 of baseplate 12 for sliding movement therein to actuate and deactuate switch 30 in response to translational motion of the distal portion 23 of operator 19. Guide portion 112 preferably has barbs 120 or other retaining means for retaining actuator 100 in track 108.

Figure 8B:
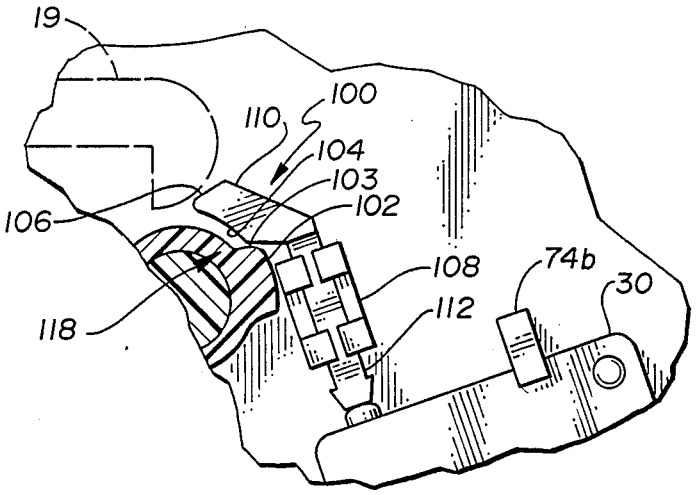
FIG. 8B shows a view of the actuators of FIG. 8A in the actuated state.
Figure 8A:
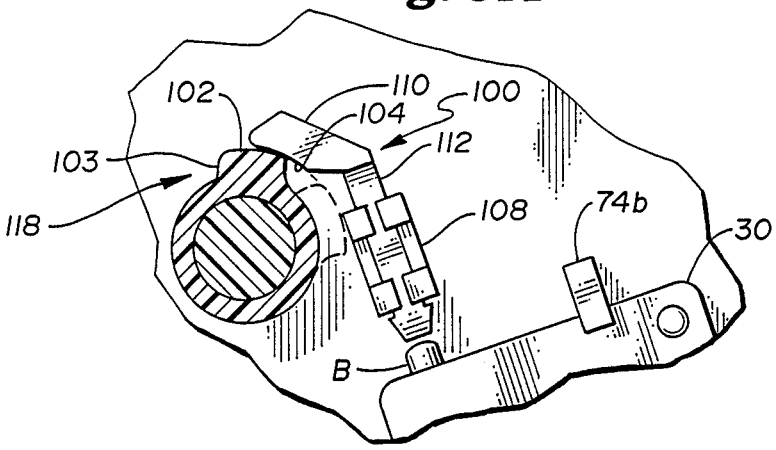
FIG. 8A shows a partial view of the first and third actuators to illustrate the interengaging surfaces in the deactuated state.

Referring now more particularly to FIGS. 8A and 8B, the third actuator 100 receives a portion of the motion of operator 19 to operate switch 30. Actuators 34 and 100 have interengaging surfaces 102, 104 preventing actuation of switch 30 while actuator 34 is in either a deactuated or intermediate position. When actuator 34 is in its actuated position, a blocking surface 103 moves away from its rest position and provides a clearance 118 permitting movement of actuator 100. As operators 19, 20 progress to the closed-door position of FIGS. 2 and 8B, blocking surface 103 rotates sufficiently to permit third actuator 100 to engage and actuate switch 30. As operator 19 progresses to the closed door position, it urges driving surface 106 on actuator 100 to move actuator 100 towards button B on switch 30, actuating switch 30.

The switch assembly 10 deactuation sequence is as follows. When the microwave oven door starts to open, operators 19, 20 begin to withdraw. Actuator 100 releases button B on switch 30, opening or deactuating switch 30. In a preferred embodiment, switch 26*a* is the first switch deactuated, followed by deactuation of switches 30 and 26*b* (in optional order). Finally switch 32 is deactuated, completing the sequence corresponding to door opening motion. In another embodiment, switch 30 is the first switch deactuated and is preferably designed to be capable of interrupting power to the microwave energy source when the door is opened before the cooking cycle is completed. In this embodiment the next switch to be deactuated is the switch 26*a* whose button B is released by the second cam surface 84. Next, cam surface 82 releases button B on the secondary interlock switch 26*b*, acting as a backup to switch 30. Finally, actuator 36 moves sufficiently far to release button B on the interlock monitor switch 32, thus deactuating switch 32 which preferably places a short circuit across the load side of the power circuit of switch assembly 10 to blow a fuse in the event of a "failed-closed" condition of both switches 26*a*,26*b* in the deactuated state.

Figure 9:
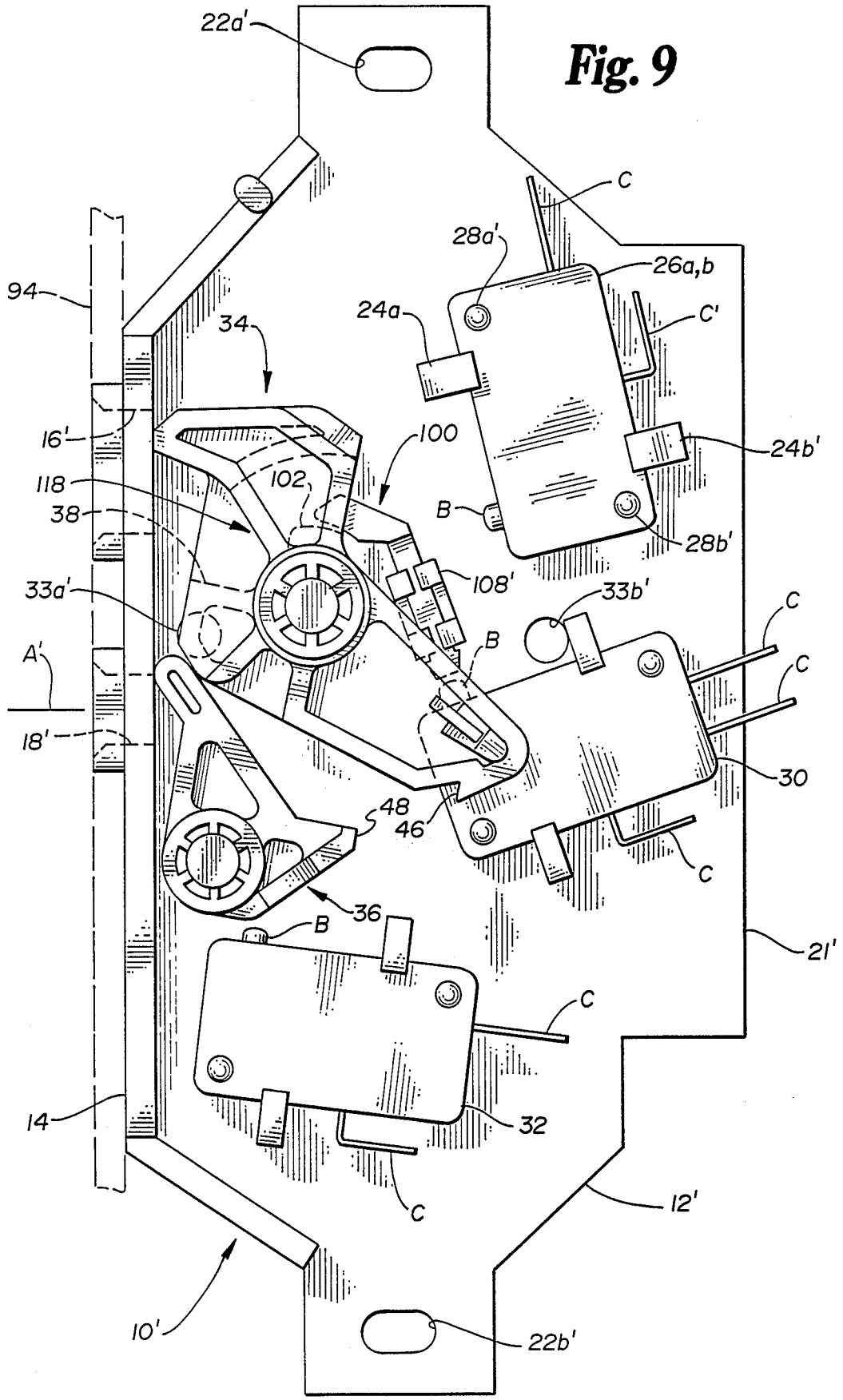
FIG. 9 shows an alternative embodiment of the interlock switch assembly.

Referring now to FIG. 9, an alternative embodiment 10' of the interlock switch assembly may be seen. In this embodiment, switch 30 has been moved, and parts 24*a*, 24*b*, 34, 74*a*, 74*b*, 76*a*, 76*b*, 100 and 108 have been reproportioned.

The invention is not to be taken to be limited to all of the details thereof as modifications and variations thereof may be made without departing from the spirit or scope of the invention.

What is claimed is:

1. An improved interlock switch baseplate assembly for use with microwave ovens comprising:

(a) a unitary baseplate having:

(i) a generally planar first surface with mounting means therein for adjustably mounting said baseplate to an adjacent surface;

(ii) a generally planar second surface projecting substantially perpendicularly from said first surface and containing first and second operator apertures therein;

(iii) a plurality of sets of switch location and retention means integrally formed as a part of said baseplate and projecting substantially perpendicularly from said first surface for positively locating and retaining first, second and third switches on said baseplate; and (iv) first and second shaft means integrally formed as a part of said baseplate and projecting substantially perpendicularly from said first surface;

(b) a first actuator positioned on said first shaft means and adapted to receive translational motion of a first operator received through said first operator aperture such that the translational motion of said first operator is converted into rotary motion for sequentially actuating and deactuating said first switch;

(c) a second actuator positioned on said second shaft means and adapted to receive translational motion of a second operator received through said second operator aperture actuator such that the translational motion of said second operator is converted into rotary motion for actuating and deactuating said second switch; wherein said first and second actuators have interengaging surfaces which prevent actuation of said first and second switches upon receiving the translational motion of one of the first and second operators without receipt of motion of the other; and (d) a third actuator retained in sliding relationship with said baseplate and adapted to receive translational motion of said first operator such that the translational motion of said first operator drives said third actuator for sequentially actuating said third switch such that said third switch is actuated after actuation of both said first and second switches.

2. The improvement of claim 1 wherein said third switch is deactuated before deactuation of either of said first and second switches.

3. The improvement of claim 1 wherein said first and third actuators are further characterized by interengaging surfaces preventing actuation of said third switch until said first actuator has rotated beyond interengagement with said second actuator.

4. The assembly of claim 1 wherein said first actuator has a blocking surface which prevents movement of said third actuator while said first actuator is in intermediate and deactuated positions.

5. The assembly of claim 4 wherein said first actuator has a clearance region which permits movement of said third actuator while said first actuator is in an actuated position.

6. The assembly of claim 5 wherein the clearance region of said first actuator is obscured from view through said first operator aperture while said first actuator is in an actuated position.

7. The assembly of claim 1 wherein said third actuator is released to actuate said third switch as said first actuator moves between intermediate and actuated positions.

8. The assembly of claim 1 wherein said third actuator has a driving surface adapted to receive and transfer translational motion of said distal portion of said first operator to said third switch when said first actuator moves from said intermediate to said actuated positions.

9. An interlock switch baseplate assembly in combination with a microwave oven comprising:

(a) a unitary baseplate having:

(i) a generally planar first surface with mounting means therein for adjustably mounting said baseplate to an adjacent surface;

(ii) a generally planar surface projecting substantially perpendicularly from said first surface and containing first and second operator apertures therein;

(iii) a plurality of sets of switch location and retention means integrally formed as a part of said baseplate and projecting substantially perpendicularly from said first surface for positively locating and retaining first, second and third switches on said baseplate; and (iv) first and second shaft means integrally formed as a part of said baseplate and projecting substantially perpendicularly from said first surface;

(b) a first actuator positioned on said first shaft means and adapted to receive translational motion of a first operator received through said first operator aperture such that the translational motion of said first operator is converted into rotary motion for sequentially actuating and deactuated said first switch;

(c) a second actuator positioned on said second shaft means and adapted to receive translational motion of a second operator received through said second operator aperture actuator such that the translational motion of said second operator is converted into rotary motion for actuating and deactuating said second switch; wherein said first and second actuators have interengaging surfaces which prevent actuation of said first and second switches upon receiving the translational motion of one of the first and second operators without receipt of motion of the other;

(d) a third actuator retained in sliding relationship with said baseplate and adapted to receive translational motion of said first operator such that the translational motion of said first operator drives said third actuator for sequentially actuating said third switch such that said third switch is actuated after actuation of both said first and second switches; and (e) said microwave oven having a pivoting microwave oven door having first and second operators projecting therefrom.

10. The combination of the interlock switch baseplate assembly and microwave oven of claim 9 wherein said first operator further comprises an enlarged distal portion.

* * * * *